US006095052A

United States Patent [19]

Bean et al.

[11] Patent Number: 6,095,052

[45] Date of Patent: Aug. 1, 2000

[54] CORROSION RESISTANT METAL BODY, BULLET BLANK, AND BULLET AND METHOD FOR MAKING SAME

[75] Inventors: Dennis L. Bean, Vicksburg; Charles Arthur Weiss, Jr., Clinton; Philip Garcin Malone; Joe Gain Tom, both of Vicksburg, all of Miss.

[73] Assignee: The U. S. Army Corps of Engineers as represented by the Secretary of the Army, Washington, D.C.

[21] Appl. No.: 09/017,730

[22] Filed: Feb. 3, 1998

[51] Int. Cl.[7] ..... F42B 12/00; B21K 21/06

[52] U.S. Cl. ..... 102/514; 102/336; 29/1.23

[58] Field of Search ..... 29/1.22, 1.23; 102/336, 514, 519

[56] References Cited

U.S. PATENT DOCUMENTS

| | | | |
|---|---|---|---|
| 4,349,612 | 9/1982 | Baldi | 102/336 X |
| 4,435,481 | 3/1984 | Baldi | 102/336 X |
| 4,503,777 | 3/1985 | Young | 102/514 |

*Primary Examiner*—Peter A. Nelson
*Attorney, Agent, or Firm*—Luther A. Marsh

[57] ABSTRACT

A bullet comprises a lead sheet and a zinc foil fixed to the lead sheet, the sheet and foil being rolled and pressure formed into a bullet having generally helical layers of the lead sheet and zinc foil. The bullet exhibits an improved environmental impact on soil, relative to all-lead bullets.

16 Claims, 2 Drawing Sheets

CORROSION RESISTANT METAL BODY, BULLET BLANK, AND BULLET AND METHOD FOR MAKING SAME

BACKGROUND OF THE INVENTION

1. Field of the Invention

This invention relates to small arms ammunition, and is directed more particularly to a bullet exhibiting corrosion resistance and, thereby, improved environmental impact on soil.

2. Description of the Prior Art

Bullets usually are of a dense lead alloy and typically corrode in soil. The release of lead in the environment from the corrosion of bullets is a problem on gun ranges. The organic acids produced by decaying vegetation in the soil react with the lead to produce soluble lead compounds which leach into groundwater.

Dense elements, other than lead, have been studied, but each carries a heavy penalty. For example, mercury and uranium are toxic, tungsten and tantalum are very expensive. Iron has been used to replace lead, either partly or wholly, but because of its lesser density does not provide the desired kinetic energy at the point of impact. Further, iron in bullets appears to increase wear in the gun barrel.

Accordingly, there exists a need for a bullet having improved environmental impact, relative to lead bullets, but retaining the performance characteristic of lead bullets.

SUMMARY OF THE INVENTION

An object of the invention is therefore to provide a bullet, and a bullet blank, and more generally, a metal body, having improved environmental impact on soil relative to all-lead bullets and other metal bodies.

A further object of the invention is to provide a method for forming a metal body, bullet blank, or bullet, exhibiting improved environmental impact.

With the above and other objects in view, a feature of the invention is the provision of a metal body comprising a substrate of lead and a layer of zinc fixed on the lead substrate.

In accordance with a further feature of the invention, there is provided a bullet blank comprising a lead sheet and a zinc foil fixed to the lead sheet, the sheet and foil being rolled into a cylindrical configuration.

In accordance with another object of the invention, there is provided a bullet comprising a lead sheet and a zinc foil fixed to the lead sheet, the sheet and foil being rolled and pressure formed into a bullet having generally helical layers of the sheet and foil.

In accordance with a still further feature of the invention, there is provided a method for forming a metal body, comprising the steps of providing a substrate of lead, fixing a layer of zinc to at least one major surface of the substrate, and forming the substrate and layer into the body.

In accordance with a still further feature of the invention, there is provided a method for forming a bullet blank, comprising the steps of providing a lead sheet, fixing a layer of zinc on a major surface of the lead sheet, and rolling the sheet and layer into a cylindrically-shaped configuration.

In accordance with still another feature of the invention, there is provided a method for forming a bullet, comprising the steps of providing a lead sheet, fixing at least one layer of zinc on at least one major surface of the lead sheet, rolling the sheet and layer into a cylindrically-shaped configuration to form a bullet blank, and pressing the bullet blank to a bullet configuration.

The above and other features of the invention, including various novel details of construction and combinations of parts and method steps, will now be more particularly described with reference to the accompanying drawings and pointed out in the claims. It will be understood that the particular devices and methods embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
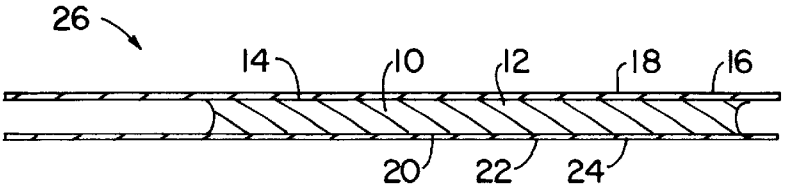
FIG. 1 is a sectional view of a lead substrate and zinc coatings fixed thereon.

Referring to FIG. 1, it will be seen that the basis for an improved corrosion-resistant metal body, bullet blank, and bullet, comprises a substrate 10, which may be in sheet form, as shown in FIG. 1, or any other desired form as, for example, spherical, depending upon the desired end use of the body being formed. In the case of bullet blanks and bullets, it is preferable that the substrate 10 be a lead sheet 12. As is well known in the art, pure lead is often too soft for many applications, including bullets. A lead-antimony alloy consisting of lead with a small percentage of antimony is the standard form of lead for bullets and is usually referred to as simply "lead". As used herein, the term "lead" refers to the lead used in bullets, i.e., lead-antimony alloy.

Fixed to at least one major surface 14 of the lead sheet 12 is a zinc layer or covering 16, which may be in the form of a zinc foil 18, preferably fused to the lead sheet 12. Preferably fixed to a second major surface 20 of the lead sheet 12 is a second zinc layer or covering 22, which may be in the form of a second zinc foil 24, and may be fused to the sheet second major surface 20. The zinc layers 16, 22 may also be in the form of a coating applied to the sheet 12.

Figure 2:
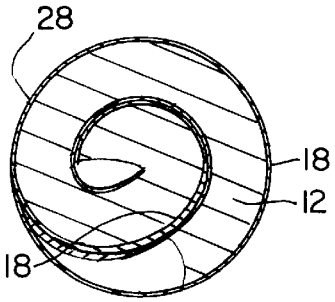
FIG. 2 is a sectional view of the substrate and coatings of FIG. 1 rolled to form a cylindrically-shaped body.
Figure 3:
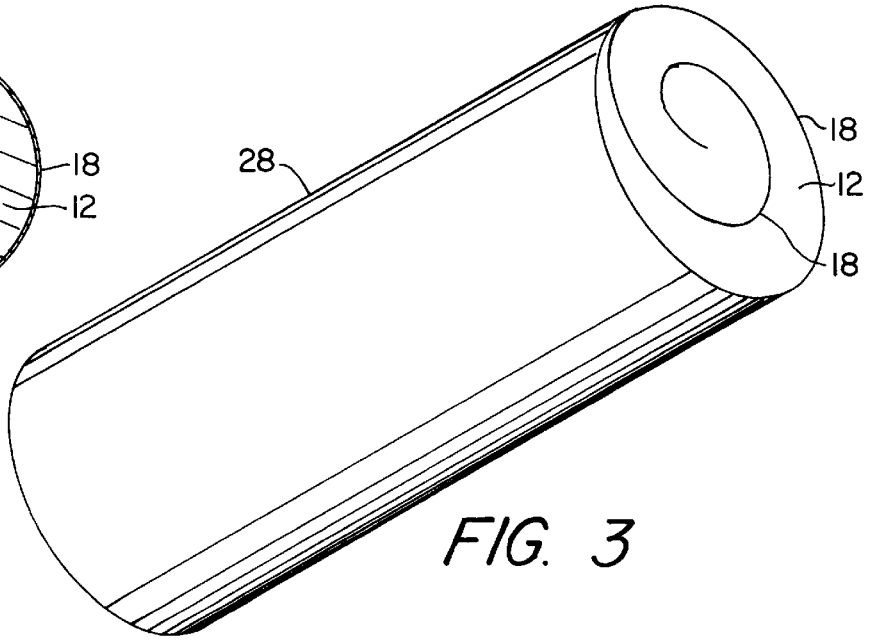
FIG. 3 is a perspective view of the body of FIG. 2.

Referring to FIGS. 2 and 3, it will be seen that the lead sheet and zinc layer composite sheet 26 is rolled into a generally cylindrically-shaped form, constituting a bullet blank 28. The bullet blank 28 accordingly has generally spiral or helical layers of lead sheet 12 and zinc layers 16.

The bullet blank 28 is subjected to a pressing operation to produce a bullet 30. The bullet 30, compared to the usual alllead prior art bullet, reduces the amount of lead released as the spent bullet weathers and corrodes. Further, if the bullet fragments, pieces of lead are accompanied by pieces of the zinc covering. Still further, the small amount of zinc used in the foils 18, 24 does not significantly reduce the overall density of the bullet. Zinc is considered an essential mineral for health and is not generally considered a toxic element. Zinc corrodes slowly, and when a hole does corrode through the zinc covering 16 and/or 22, the zinc acts as a sacrificial metal and reduces the rate of corrosion of the lead.

Figure 4:
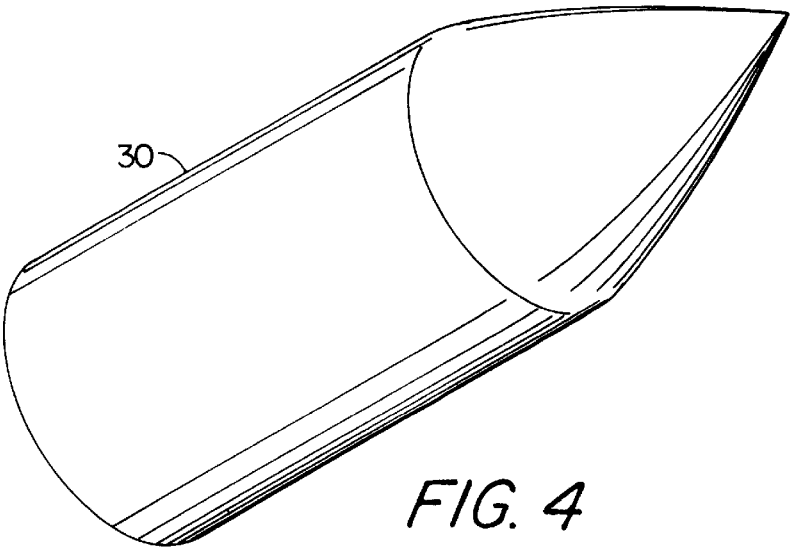
FIG. 4 is a perspective view of a bullet formed from the body of FIG. 3.
Figure 5:
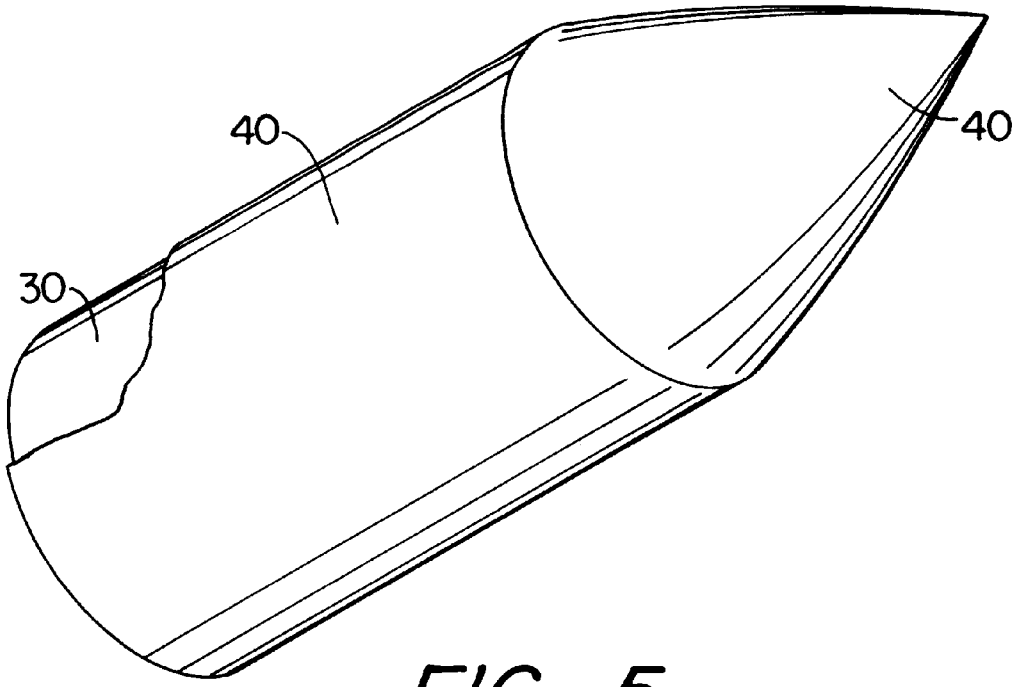
FIG. 5 is similar to FIG. 4, but illustrative of an alternative embodiment of bullet.
Figure 6:
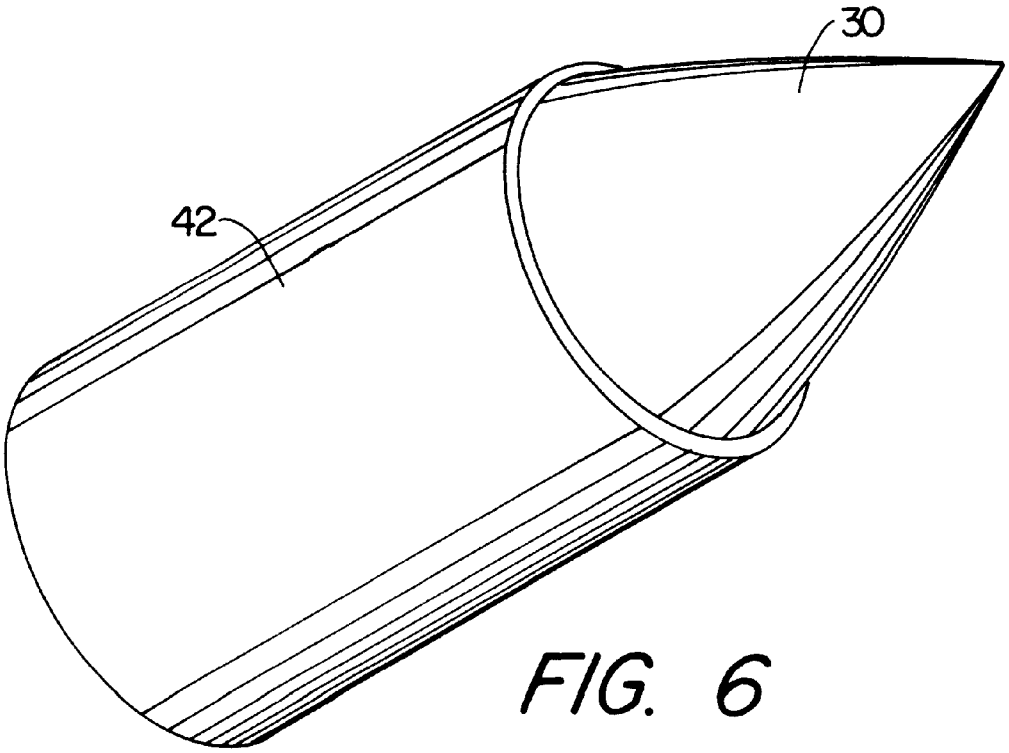
FIG. 6 is similar to FIG. 5, but illustrative of another alternative embodiment of bullet.

Many modern high-speed bullets require a relatively hard material on the outer surface, particularly where the bullet contacts the rifling in a barrel. In FIGS. 5 and 6, there are shown alternative embodiments in which the bullet 30 of FIG. 4 is covered with a full length jacket 40 (FIG. 5) of copper or brass or a partial-jacket 42 (FIG. 6) of copper or brass.

It is to be understood that the present invention is by no means limited to the particular construction herein disclosed and/or shown in the drawings, but also comprises any modifications or equivalents within the scope of the disclosure. For example, while the above description and the drawings relate primarily to formation of a bullet blank and bullet, and while the invention is expected to find utility in that area, it will be apparent that the invention readily is applicable to metal bodies generally, where concern for lead solubility poses a problem, such as in lead weights for ship ballast, lead shielding for radiation protection, and lead shot at skeet and trap ranges.

There is thus provided a bullet blank and bullet and, more generally, a metal body, exhibiting improved environmental qualities over similar items of substantially wholly lead structure.

What is claimed is:

1. A method for forming a bullet blank, the method comprising the steps of:

providing a lead sheet;

fixing a layer of zinc on a first major surface of said lead sheet; and rolling said sheet and layer into a cylindrically-shaped configuration.

2. The method in accordance with claim 1 wherein said layer is a foil.

3. The method in accordance with claim 1 including the further step of fixing a second layer of zinc on a second major surface of said lead sheet, and rolling said sheet and said layers into said cylindrically-shaped configuration.

4. A method for forming a bullet, the method comprising the steps of:

providing a lead sheet;

fixing at least one layer of zinc on at least one major surface of said lead sheet;

rolling said sheet and layer into a cylindrically-shaped configuration to form a bullet blank; and pressing said bullet blank to a bullet configuration.

5. The method in accordance with claim 4 wherein said layer of zinc comprises zinc foil fixed to said major surface of said lead sheet.

6. The method in accordance with claim 4 wherein said at least one layer of zinc comprises first and second layers of zinc, wherein said at least one major surface comprises first and second major surfaces, and one of said layers is respectively fixed to each of said major surfaces.

7. A bullet blank for forming a bullet, said blank comprising a sheet of lead and a zinc foil fixed to said sheet, said sheet and foil being rolled into a cylindrical configuration.

8. A bullet blank for forming a bullet, said blank comprising a lead sheet, a first zinc foil fixed to a first major surface of said sheet, and a second zinc foil fixed to a second major surface of said sheet, said sheet and first and second foils being rolled into a cylindrical configuration.

9. A bullet comprising a sheet of lead and a zinc foil fixed to said sheet, said sheet and foil being rolled and pressure formed into a bullet having generally helical layers of said sheet and said foil.

10. The bullet in accordance with claim 9 further comprising a jacket of a material harder than said lead and said zinc and covering at least a portion of said bullet subject to contact with a gun barrel during firing of said bullet.

11. The bullet in accordance with claim 10 wherein said harder material is selected from a group of materials consisting of brass and copper.

12. A bullet comprising a sheet of lead, a first zinc foil fixed to a first side of said sheet, and a second zinc foil fixed to a second side of said sheet, said sheet and said foils fixed thereon being rolled and having the form of a bullet.

13. The bullet in accordance with claim 12 further comprising an outer layer fixed to an outer one of said zinc foils and extending throughout at least a portion of the length of said bullet, said outer layer being of a material harder than said foils and said sheet.

14. The bullet in accordance with claim 13 wherein said outer layer material is selected from a group of materials consisting of brass and copper.

15. The method in accordance with claim 4 including the additional step of fixing an outer layer on said bullet, said outer layer being of a material harder than said zinc layer and said lead sheet, said outer layer extending throughout at least a portion of the length of said bullet.

16. The method in accordance with claim 4 wherein said harder material is selected from a group of materials consisting of brass and copper.

* * * * *